US011944869B2

(12) United States Patent
Schmidt

(10) Patent No.: US 11,944,869 B2
(45) Date of Patent: Apr. 2, 2024

(54) USER INTERFACE FOR A MOTORIZED ISOKINETIC RESISTANCE EXERCISE MACHINE

(71) Applicant: Schmidt Design, LLC, Darien, CT (US)

(72) Inventor: David Schmidt, Darien, CT (US)

(73) Assignee: Schmidt Design LLC, Darien, CT (US)

( * ) Notice: Subject to any disclaimer, the term of this patent is extended or adjusted under 35 U.S.C. 154(b) by 87 days.

(21) Appl. No.: 17/196,007

(22) Filed: Mar. 9, 2021

(65) Prior Publication Data

US 2021/0205664 A1 Jul. 8, 2021

Related U.S. Application Data

(63) Continuation of application No. 16/411,837, filed on May 14, 2019, now Pat. No. 10,946,245, which is a continuation of application No. 15/638,700, filed on Jun. 30, 2017, now Pat. No. 10,328,307, which is a continuation of application No. 14/922,164, filed on Oct. 25, 2015, now Pat. No. 9,724,563.

(60) Provisional application No. 62/068,791, filed on Oct. 27, 2014.

(51) Int. Cl.

| | |
|---|---|
| ***A63B 24/00*** | (2006.01) |
| ***A63B 21/00*** | (2006.01) |
| ***A63B 21/002*** | (2006.01) |
| ***A63B 21/005*** | (2006.01) |
| ***A63B 23/035*** | (2006.01) |
| ***A63B 23/12*** | (2006.01) |
| ***A63B 71/06*** | (2006.01) |

(52) U.S. Cl.

CPC ..... *A63B 24/0062* (2013.01); *A63B 21/002* (2013.01); *A63B 21/0058* (2013.01); *A63B 21/154* (2013.01); *A63B 21/4035* (2015.10); *A63B 21/4043* (2015.10); *A63B 23/03525* (2013.01); *A63B 23/1209* (2013.01); *A63B 24/0087* (2013.01); *A63B 71/0622* (2013.01); *A63B 23/03508* (2013.01); *A63B 2024/0093* (2013.01); *A63B 2071/063* (2013.01); *A63B 2071/0652* (2013.01); *A63B 2220/17* (2013.01); *A63B 2220/20* (2013.01); *A63B 2220/51* (2013.01); *A63B 2220/58* (2013.01); *A63B 2225/20* (2013.01); *A63B 2225/50* (2013.01)

(58) Field of Classification Search

CPC ..... A63B 21/0058; A63B 24/0087; A63B 2220/30; A63B 2225/50; A63B 2220/51; A63B 24/0062; A63B 21/153; A63B 2225/20; A63B 2024/0093; A63B 2220/13; A63B 21/4035; A63B 21/00058; A63B 23/12; A63B 24/00; A63B 21/154

USPC ..... 482/5, 121–124, 126–130

See application file for complete search history.

(56) References Cited

U.S. PATENT DOCUMENTS 4,082,267 A * 4/1978 Flavell ..... A63B 23/03541 74/141

4,184,678 A 1/1980 Flavell 4,607,841 A 8/1986 Gala (Continued)

*Primary Examiner* — Andrew S Lo

(57) ABSTRACT

An exercise device consisting of two or more flexible elements originating from different locations and connected to a common handle capable of being moved in a variety of directions. Each element also connected to a resistance mechanism and a force measuring device whereby a user interface and microcomputer determine force and direction and enable creation of customized workouts.

5 Claims, 4 Drawing Sheets

(56) References Cited

U.S. PATENT DOCUMENTS

| | | | | |
|---|---|---|---|---|
| 5,080,816 | A | 1/1992 | Sakamoto et al. | |
| 5,362,298 | A | 11/1994 | Brown | |
| 5,409,435 | A | 4/1995 | Daniels | |
| 5,435,798 | A * | 7/1995 | Habing | A63B 21/0615 482/903 |
| 6,027,429 | A * | 2/2000 | Daniels | A63B 21/00845 482/92 |
| 6,280,361 | B1 | 8/2001 | Harvey | |
| 8,821,428 | B2 | 9/2014 | Tanaka | |
| 9,352,181 | B2 | 5/2016 | O'Neil | |
| 9,409,047 | B2 | 8/2016 | Kamenskikh | |
| 2002/0139185 | A1 | 10/2002 | MacFarlane | |
| 2005/0143230 | A1 | 6/2005 | Dalebout | |
| 2009/0124461 | A1 | 5/2009 | Pinto | |
| 2010/0113222 | A1 | 5/2010 | Radow | |
| 2011/0172058 | A1 | 7/2011 | Deaconu | |
| 2011/0251021 | A1 * | 10/2011 | Zavadsky | A63F 9/24 482/5 |
| 2012/0202656 | A1 | 8/2012 | Dorsay | |
| 2013/0065730 | A1 | 3/2013 | Camerota | |
| 2014/0194250 | A1 | 7/2014 | Reich | |
| 2014/0287876 | A1 | 9/2014 | Etter | |
| 2014/0342878 | A1 | 11/2014 | Hashish | |

* cited by examiner

USER INTERFACE FOR A MOTORIZED ISOKINETIC RESISTANCE EXERCISE MACHINE

CROSS-REFERENCE TO RELATED APPLICATION

This application claims the benefit of U.S. Provisional Patent Application No. 62/068,791 filed Oct. 27, 2014, U.S. Non-Provisional patent application Ser. No. 14/922,164 filed Oct. 25, 2015, now U.S. Pat. No. 9,724,563, U.S. Non-Provisional patent application Ser. No. 15/638,700 filed Jun. 30, 2017, now U.S. Pat. No. 10,328,307, and U.S. Non-Provisional patent application Ser. No. 16/411,837 filed May 14, 2019, all of which are hereby incorporated by reference in their entirety herein.

BACKGROUND OF THE INVENTION

I. Field of the Invention

The present disclosure relates generally to a user interface for a motorized exercise machine, and more specifically to a programmable and variable resistance machine for measuring and displaying various force and directional outputs.

II. Description of the Prior Art

Weight based resistance exercise generally relies on a fixed load (e.g. 50 lbs.) throughout the entire exercise range of motion, while motorized isokinetics continuously varies the load it delivers to accommodate the user. Isokinetic resistance works by allowing a moving element, such as a handle or grip, to travel at a fixed speed. As a user engages the handle and tries to increase speed, he is met with increased resistance as the handle speed remains unchanged. This may be accomplished with a motorized isokinetic resistance system wherein a motor controller regulates the speed and torque of the motor, where speed varies with input voltage, and torque varies with current.

Both conventional weight based resistance exercise and isokinetic systems have their advantages and disadvantages. For example, monitoring a weight based workout involves counting repetitions and keeping track of the weight used, and since force is continually changing with isokinetic resistance, tracking progress during use is even more challenging. Additionally, if the isokinetic system utilizes multiple measuring devices, there is a need for multiple readouts.

The present disclosure overcomes the problems associated with conventional weight based and isokinetic resistance systems by utilizing a logic device to make decisions about what information is to be presented on a single digital or graphic display. Accordingly, it is a general object of this disclosure to provide an improved user interface for a motorized isokinetic resistance exercise machine.

It is another general object of the present disclosure to provide an exercise machine that manages the speed and torque produced at the isokinetic resistance mechanism.

It is a more specific object of the present disclosure to provide an improved force measuring device for accurate calculation and display.

These and other objects, features and advantages of this disclosure will be clearly understood through a consideration of the following detailed description.

SUMMARY OF THE INVENTION

According to an embodiment of the present disclosure, there is provided an exercise apparatus having user engageable grips coupled to an isokinetic resistive mechanism and two force measuring devices. The force measuring devices are each capable of measuring force in one direction. A user interface provides the exerciser the ability to display the difference in force values between the grips.

BRIEF DESCRIPTION OF THE DRAWINGS

The present disclosure will be more fully understood by reference to the following detailed description of one or more preferred embodiments when read in conjunction with the accompanying drawings, in which like reference characters refer to like parts throughout the views and in which.

DESCRIPTION OF THE PREFERRED EMBODIMENTS

Figure 1:
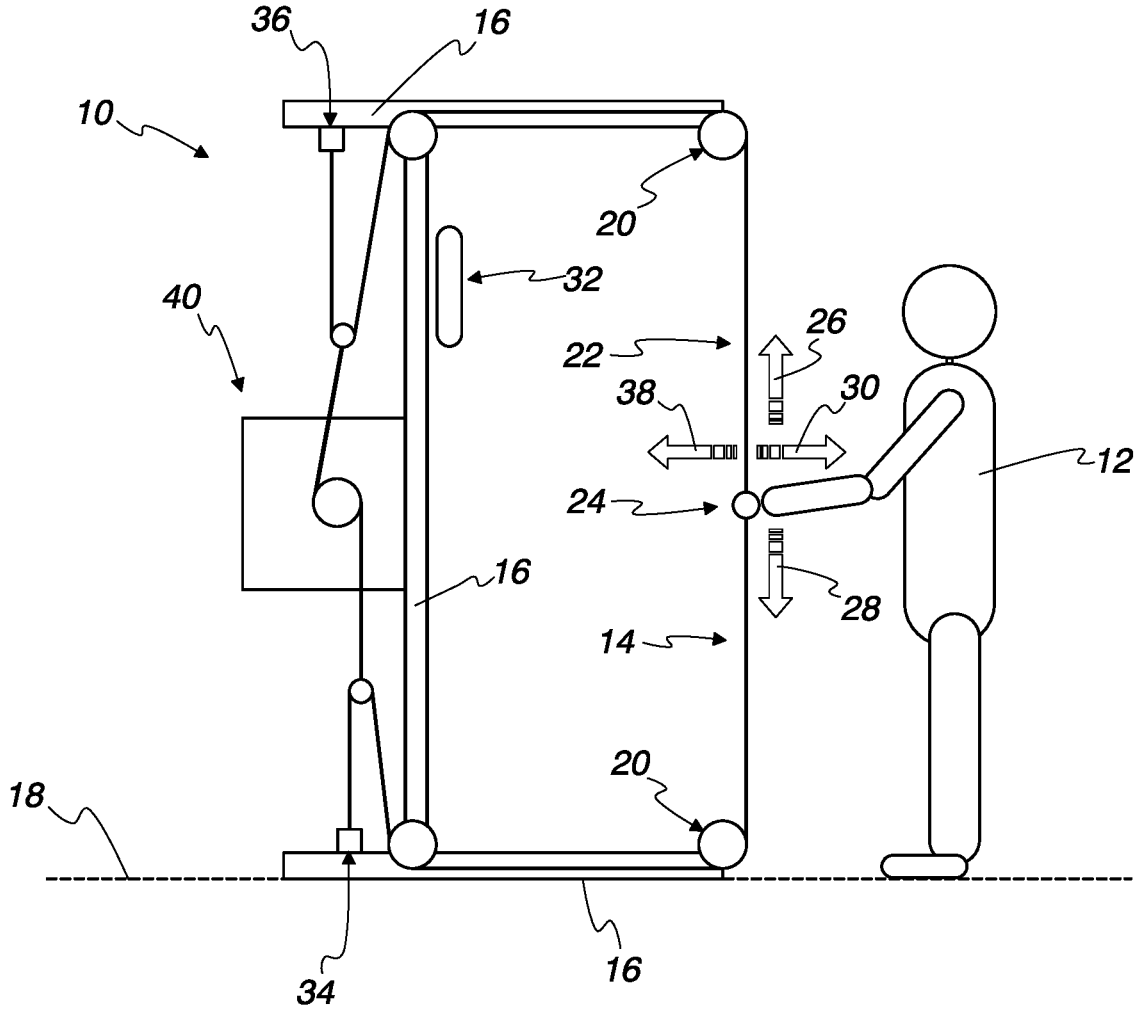
FIG. 1 is a side view of a resistance machine according to the principles of an embodiment of the present disclosure.
Figure 2:
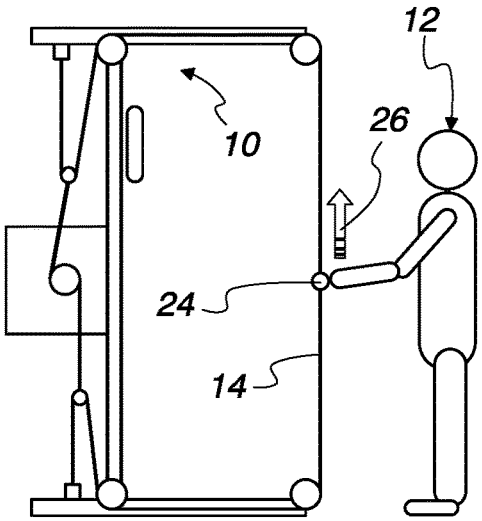
FIG. 2 is the side view of FIG. 1 with the user forcing the handle up.

One or more embodiments of the subject disclosure will now be described with the aid of numerous drawings. Unless otherwise indicated, use of specific terms will be understood to include multiple versions and forms thereof.

In any event, turning now to the Figures, and in particular FIGS. 1-4, the elements of a dual motion isokinetic machine 10 are generally shown, together with the user 12. It will be understood that this machine 10 may utilize two or more sets of opposing ropes (infra). As such, while the side views herein only show one set, it will be appreciated that at least one other set may be positioned directly behind the first set and out of view in the figures. Accordingly, it will be understood that single reference numerals may refer to multiple sets in alternate embodiments. In this first embodiment, a bottom rope 14 exits the frame 16 from near the floor 18 through a multi-directional pulley 20, and a top rope 22 exits the frame 16 above the bottom rope 14 through another multi-directional pulley 20. Both ropes meet at a common handle or grip 24 for the user 12 to engage. Upon user engagement, three possible motions include up 26, down 28, and out 30, where up 26 applies a force to the lower rope 14, down 28 applies force to the upper rope 22, and out 30 applies force to both ropes simultaneously.

A user interface 32, which may be in the form of a touch-screen display, includes a computer, such as a Google Nexus 10 (ten). It is desirable for the user interface 32 to have the ability to measure and display the force applied in any of three directions. A separate force detecting device is used to detect force applied to each rope. This can be accomplished by using a bottom strain gauge 34 to measure force from the bottom rope 14, and a top strain gauge 36 to measure force from the top rope 22. As such, these force measuring devices (e.g. load cells) are located at each of the isokinetic moving elements to measure the force applied by the user 12 and input into the computer 32. The output of the strain gauges will be proportional to the amount of force applied to the respective ropes. A visual display on the interface 32 such as alphanumeric characters, a bar graph, etc. can be used to show this force in lbs., kgs., etc. While the present embodiment utilizes ropes and load cells/strain gauges, it will be appreciated that any user engageable grip coupled, with or without a flexible element, to a force measuring device may be used.

Figure 3:
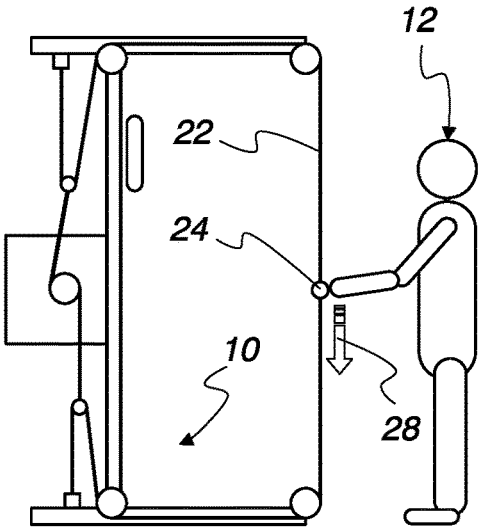
FIG. 3 is the side view of FIG. 1 with the user forcing the handle down.
Figure 4:
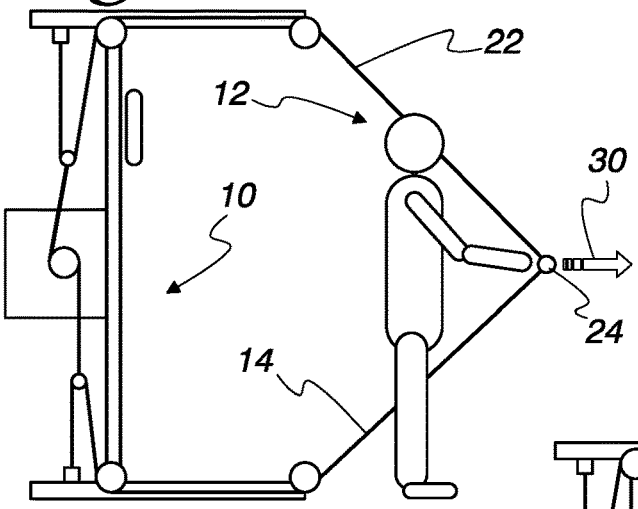
FIG. 4 is the side view of FIG. 1 with the user forcing the handle out.

Thus far described, the system provides accurate measurement in either of the two directions, up 26 (FIG. 2) and down 28 (FIG. 3). However, when the handle is pulled out 30 (FIG. 4) (or pushed in 38), both force measuring devices will give a reading representing a fraction of the total force applied against the resistive mechanism 40. Rather than displaying this information with two separate fractional readouts for each direction, the machine 10 calculates and displays the true user force and direction (e.g. up, down, out and in).

In particular, each measuring device has a tare or zero value that is initially recorded and saved by the microprocessor. Accordingly, when a single measuring device exceeds its tare value (i.e. a user pulls straight up or pushes straight down), the appropriate directional indicator (up or down) is displayed and the value from that force measuring device is displayed. However, when both force measuring devices exceed their tare values (i.e. the user is either pulling 30 or pushing 38), then both ropes are being pulled simultaneously and the force vector applied is not parallel to either of the ropes. In such an action, in order to calculate an accurate force to be displayed, a correctional factor needs to be applied.

Figure 5:
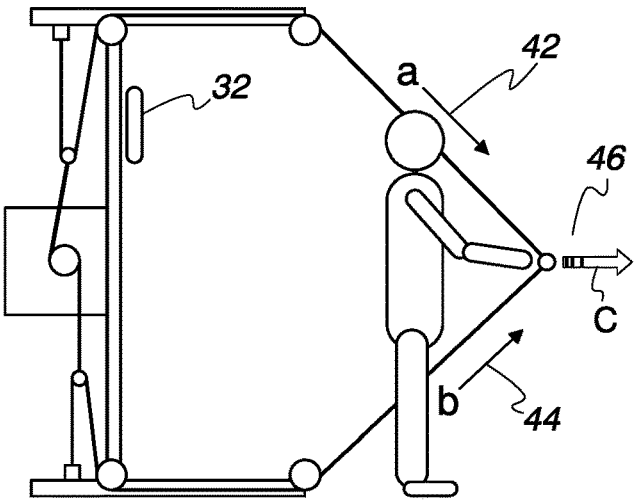
FIG. 5 is the side view of FIG. 1 illustrating a correctional factor.

One such correctional factor is the Pythagorean Theorem ($a^2+b^2=c^2$) illustrated in FIG. 5 where the 'a' force vector 42 is the value of one of the force measuring devices, the 'b' force vector 44 is the value of the other force measuring device and the 'c' force vector 46 is the actual force exerted. The processor makes the calculations and the user interface 32 displays a directional indicator as well as the actual force exerted.

Although the above discussion contemplates a single set of opposing ropes, it may be desirable to utilize two or more sets of opposing ropes for a single exercise machine. In this case, the user interface can include a separate display for each of the combined sets of ropes. For example, if two sets of ropes are provided, the user will be able to observe the strength of his left vs. right side by viewing a left and right display. Other users may only be interested in the total combined amount of force that they are capable of producing. Accordingly, another feature of the disclosure is the ability to add the left and right outputs (or more if there are more than two sets of ropes) to display a combined total output.

Figure 6:
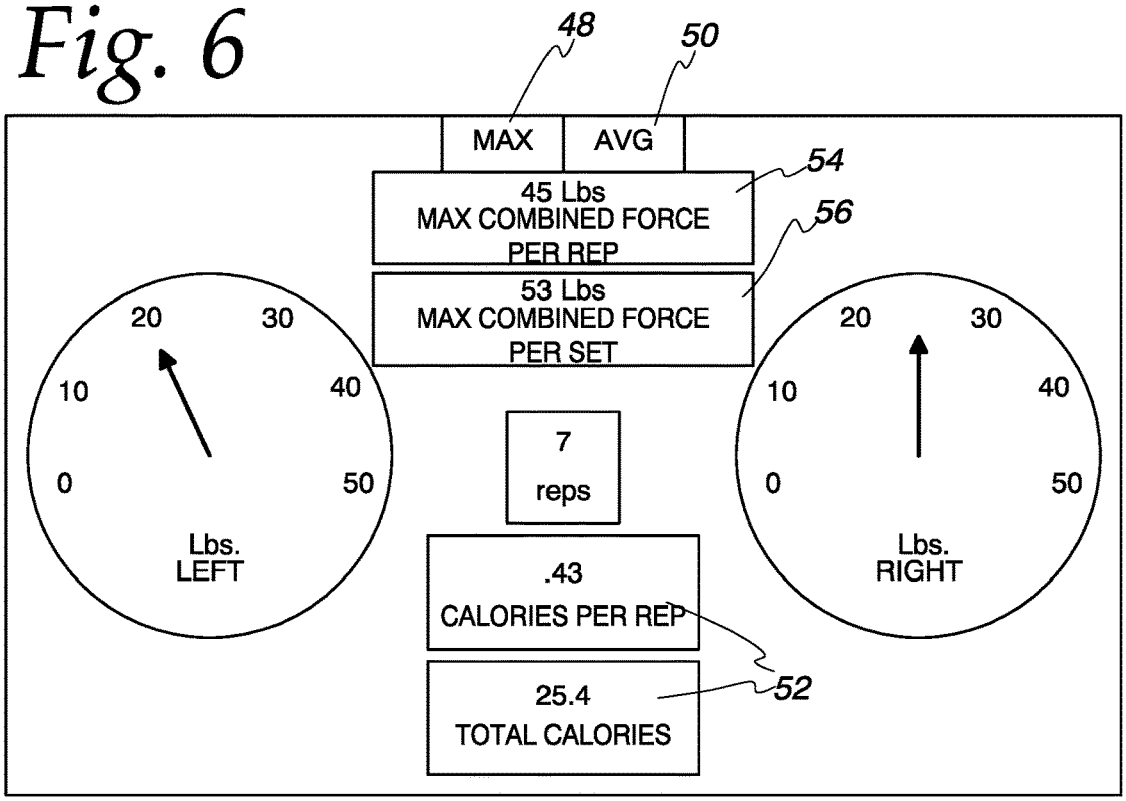
FIG. 6 is a screen shot of the user interface of FIG. 1 showing a sample left, right and total force displayed with maximum and average settings.

When exercising with isokinetic resistance, a user is continuously changing the amount of force exerted throughout his range of motion for each repetition. Therefore, unlike weight lifting where the force remains constant e.g. 50 lbs., a similar exercise done with isokinetics might see the user start at 0 lbs. of force at the beginning of the movement, and finish with 90 lbs. of force at the end of the movement. Because of this dynamic, and turning now to FIG. 6, there are several metrics which can be useful to the user: maximum force 48 will show the peak strength within the range of motion; average force 50 can help train a user to maintain proper form and avoid impulse loads; and work 52 (or Calories) encourages the user to maintain strong force production throughout the full range of motion to achieve maximum benefit from the exercise. Maximum force is recorded by locking the display at the highest force reading recorded for a particular repetition 54, set 56, or entire workout. Average force is calculated by summing multiple samples of force readings throughout a repetition or set, and dividing by the number of samples taken. In the preferred embodiment, samples are taken every 10 ms to create an accurate average force reading. In physics, work=force× distance. The present disclosure allows for the display of actual work done with great accuracy. Using the technique described above, average force throughout a repetition or set can be measured.

When using a motorized, speed controlled isokinetic mechanism for resistance, the distance of travel per repetition or set can be derived by using a look-up table and a clock. Each speed setting corresponds to a particular rope pay-out rate which can be measured in inches/second. A look-up table is created with the rate associated with each possible speed setting. Distance is calculated by starting a clock when a force measuring device exceeds its tare value, and stopping the clock when the force measuring device falls back to its tare value. Multiplying the rate and elapsed time will yield the distance traveled by the user. This distance multiplied by the average force equals work done. This can be displayed as work per repetition, work per set, or total work for an exercise session. The units displayed can be Joules, or with the proper multiplier, caloric expenditure, "Calories burned".

Figure 7:
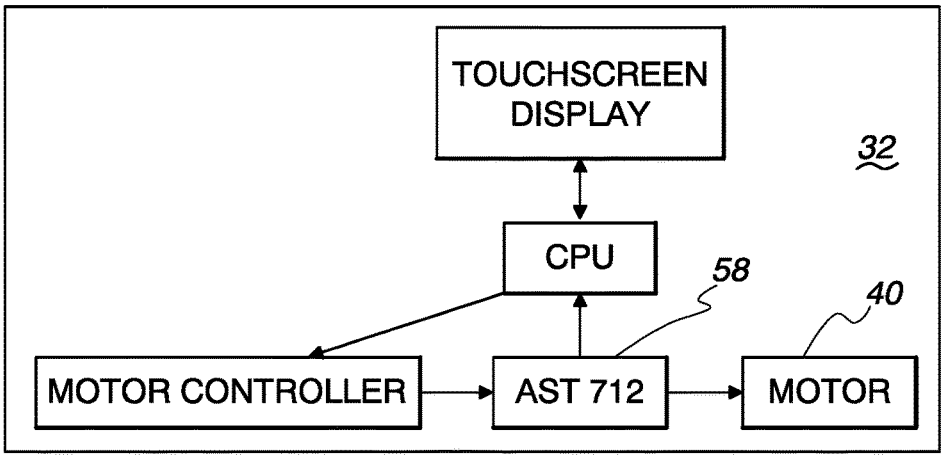
FIG. 7 is a logic flow according to the principles of an embodiment of the present disclosure.

An alternative method for determining force and work involves monitoring the power dissipation of the motor during exercise. In one embodiment, as shown in FIG. 7, an Allegro™ATS712 chip 58 within the user interface 32 is used to measure the current consumption of the motor 40 during operation. Idle current values (no pressure on the ropes) are first recorded for all of the potential speeds of the motor and placed into a memory. During use, the current consumption is continually monitored, e.g. a value is read every 10 ms. When the current value exceeds the idle value, the differential is calculated (actual current value minus idle current value). By mathematically averaging these numbers and multiplying by a predetermined calibration constant, average force applied can be estimated and displayed on a per repetition, per set, or per work-out basis. Alternatively, the maximum value recorded can be multiplied by the predetermined calibration constant and displayed as the maximum force applied. By multiplying the average force times the travel distance (as calculated above), work, or Calories can be calculated and displayed.

The present disclosure can present dynamic force and work metrics using both analog and digital displays. Although a digital display is useful in its ability to give highly accurate readings, an analog display can be more "user friendly" in its ability to accurately depict a dynamic metric.

One drawback to using an analog bar graph is that in choosing a scale, one must pick a range which may not be suitable for all users. For example, a scale of 0-400 lbs. might work well for a football player who typically exerts 300 lbs. of force. In this case, the bar graph will range from zero to 75% of the full scale. However when a weaker person uses the same display and exerts 12 lbs., the bar graph will only be active from zero to 3% of the full scale, an almost indiscernible amount of movement.

To overcome this issue, an embodiment of the disclosure uses an automatically scaling bar graph. When initially presented, the scale range is 0-25 lbs. If a user works within this range, the scale remains constant. However, when the user pushes hard enough to exceed a value, e.g. 95% of the full range, the scale range changes to 0-50 lbs. When 95% of this scale is exceeded, auto-scaling again takes place to display a 0-100 lbs. scale, and so on until the maximum scale is presented. The scale is reset to its original range when the user presses "next set" or "quick start/reset" on the user interface.

Making an abrupt change from one scale to the next can result in confusion for the user as they will see the bar graph drop instantaneously from 95% of full scale, to 47.5% of full scale. Animation can be added to improve user's ability to smoothly follow the transition. In an embodiment, the transition involves displaying multiple scales in ascending value, e.g. 10 scales in quick succession, e.g. 50 ms each to create a smooth transition with the scale visually compressing as new high numbers are added. This process can be used for increasing or decreasing the scale range.

A muscle imbalance means that the strength or size of muscle on one side of the body is not symmetrical to the strength or size of muscle on the other side of the body. Muscle imbalances can happen for all kinds of reasons. Athletes who play baseball, or golf for example, may produce muscle imbalances because they use a dominant side to throw or swing. Gym veterans and newbies alike can also develop muscle imbalances by relying on their naturally dominant side to support their lifts. It is always best to find the root cause of a muscle imbalance, and to make a precise effort to fix it. Muscle imbalance shouldn't be taken lightly as they can create bigger problems, from posture to spinal positioning, which can ultimately lead to issues walking, sitting and even lying down as time progresses.

Figure 8:
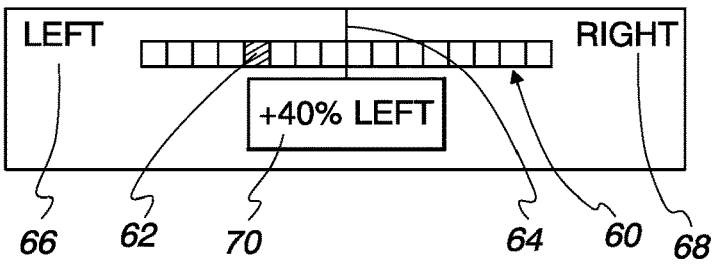
FIG. 8 is a screen shot of the user interface of FIG. 1 showing a sample force imbalance indicator.

In one embodiment, and referring now to FIG. 8, an analog visualization within the user interface 32, e.g. horizontal bar graph 60, moving dot 62, etc. referenced to a centerline 64 is provided which gives a real-time indication of muscle balance. If left and right force measuring devices record the same amount of force, the indicator 62 is positioned at the centerline 64. When one side sees a greater force exerted than the other, the indicator is moved in that direction to coach the user for proper adjustment. In the example of FIG. 8, the left side 66 of the user is shown to be 40% 70 stronger than the right side 68 of the user. While in another embodiment, a chart-plotter draws two lines, each a different color, which represent left and right force output. As a user exercises, he can try to match the superimposed lines to achieve proper balance. In yet a further embodiment, the left and right side force readings are compared, and when they deviate in magnitude by more than e.g. 30%, for more than e.g. 3 repetitions, a message can be sent to the user indicating that an imbalance is apparent. The message may suggest that the user see a trainer or therapist to address the imbalance. The message may also be sent via email, Bluetooth, wifi, etc. to a clinician or therapist within a facility.

During resistance based exercise it is often advantageous to count the number of repetitions completed for each set performed. This is generally an easy task, however when an isokinetic exercise machine with two opposing motions is utilized, more complicated exercises are often times performed making repetition counting more difficult. With input from force measuring/detecting devices for each of the isokinetic movement elements, the present invention electronically decides which motions constitute a repetition, what direction the movement was performed, and in some instances, what type of exercise was performed, e.g. biceps curl. This information is then counted, displayed, and in some instances used for reporting. In one form, counts are in ascending order to sum all repetitions completed. In another form (e.g. while doing a programmed work-out) counts are in descending order showing remaining repetitions to be performed.

Logic is used to decide the conditions for determining when a repetition has been completed. For example, during a workout, there may be 4 different exercises which require four different logic decisions to determine how to characterize the movement. Examples of one repetition of each exercise may include: 1) Biceps hard up, light down—requires the user to pull up with force, and down with no force, and only the lower strain gauge will report a force value; 2) Triceps hard down, light up—requires the user to pull down with force, and up with no force, and only the upper strain gauge will report a force value; 3) Overhead press/Lat pull-down—requires the user to push up with force and then pull down with force, where first the lower, then the upper strain gauges report a value; and 4) Chest press—requires the user to push out with force and return with no force, where both strain gauges report force simultaneously. Repetitions for the above four examples are determined as follows: 1) If force on the lower rope exceeds tare value and then returns to tare value while force on the upper rope stays at tare value, and then lower rope exceeds tare value again, one repetition is reported in the upward direction; 2) If force on the upper rope exceeds tare value and then returns to tare value while force on the lower rope stays at tare value, and then the upper rope exceeds tare value again, one repetition is reported in the downward direction; 3) If force on the lower rope exceeds tare value and then returns to tare value followed by the upper rope exceeding tare value and then returning to tare value, one repetition is reported with a "both" direction; and 4) If force on both ropes exceeds tare value simultaneously and then returns to tare value, one repetition is reported with an "out" direction.

In another embodiment, two sets of dual motion isokinetic movements are provided such that two handles are approximately shoulder distance apart. This further adds to the complexity of the task of reporting a repetition as even more complex combinations of movements are achievable, e.g. alternating military press/lat pull down, where one arm presses upward while the other arm pulls downward followed by opposite motion of each arm in order to complete one repetition. By knowing where and when a force is applied to the outputs of a multi-output isokinetic resistance machine, the present invention can report and track a variety of movements.

An isokinetic resistance device is driven by an electric motor, and motor current consumption is monitored by the user interface. An idle current consumption value is recorded when the motor is running, but no force is exerted on the machine. When a current consumption value exceeds the idle current consumption value, then returns to the idle current consumption value, one repetition if reported.

An exercise list or a variety of video clips showing individual exercises is stored or accessible on the computer. With isokinetic resistance, some exercises e.g. chest press, are performed at slower speeds than others e.g. high-to-low chop. Therefore, a predetermined default motor speed is associated with each exercise of the video library or exercise list. When an exercise or video is selected from the list, the computer commands the motor to run at the proper default speed for that exercise.

Figure 9:
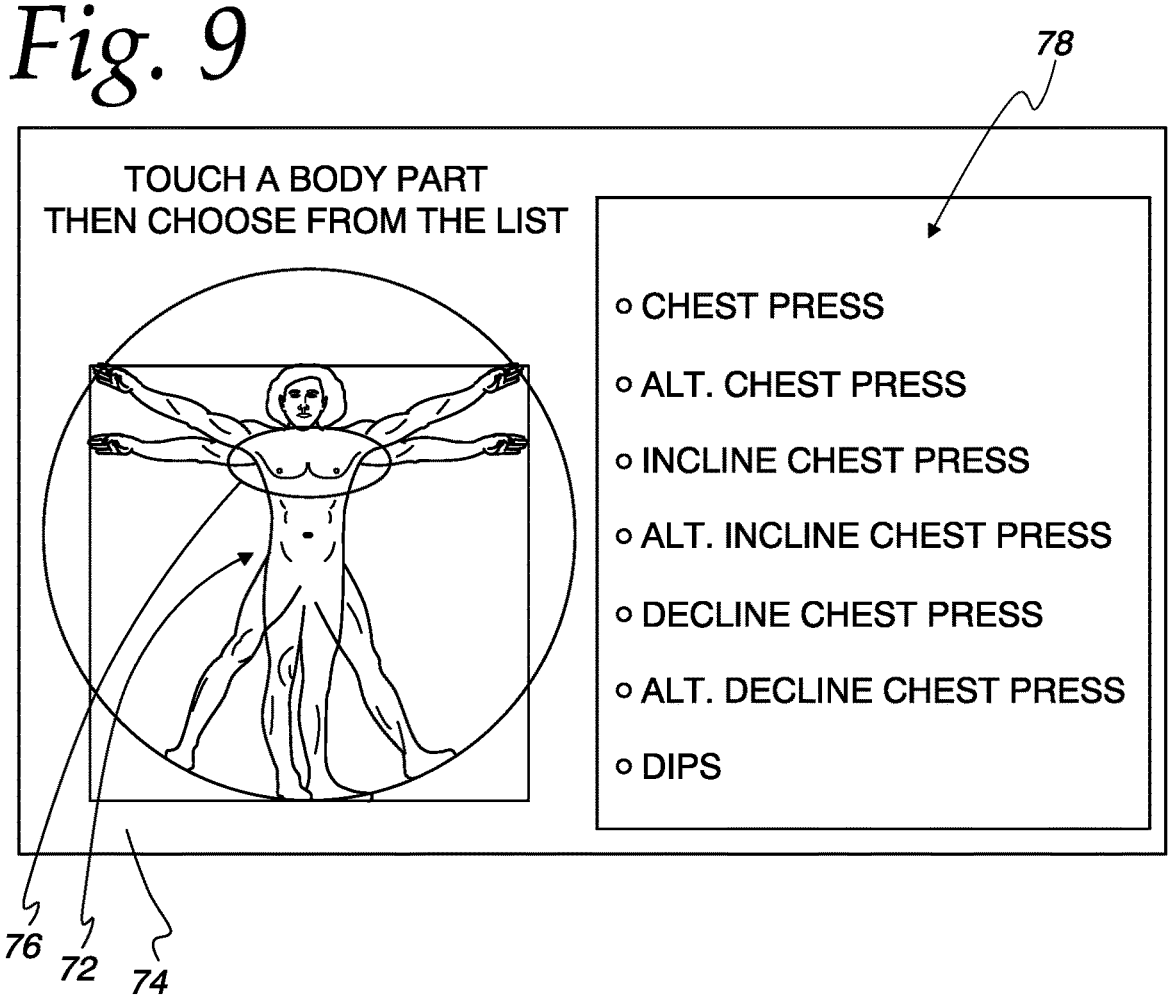
FIG. 9 is a screen shot of the user interface of FIG. 1 showing a human figure filter for exercise videos.

To access the videos, a scrollable list is provided. In one embodiment, as shown in FIG. 9, a filter allows an easier means of finding specific exercises on the list. An anatomical graphic of a human body 72 is displayed on the touch-screen 74 with touch-points located over each muscle group, e.g. biceps, shoulders, back, etc. Within the list, exercises for particular muscles are grouped together, e.g. biceps, shoulders, back, etc. When a user touches a point on the human body, (i.e. Chest 76) the exercise list displays the appropriate group 78 of exercises or videos.

Varying the speed of the isokinetic motion varies the perceived intensity of the exercise by the user. Sometimes similar exercises are performed at different speeds to achieve different results. Videos within the exercise list are generally only filmed once with isokinetic speed set at a particular level. When a user exercises at a speed that is different from the speed used in the video, it can be confusing to watch, especially if the user tries to match the speed of the model in the video. In one embodiment, the present disclosure changes the speed of the video to match the selected isokinetic speed of motion.

Another feature of the disclosure is the ability to lead a user through an entire workout consisting of multiple exercises. The user can select from a number of preprogrammed exercise routines on a list. Once selected, a message appears on the touchscreen showing how many repetitions per set are recommended. A toggle is provided to allow the user to increase or decrease this number. Additionally, the user is given the option to use default motor speed for the exercises, or increase or decrease default motor speed e.g. +10%. When the program is started, a video demonstrating the first exercise to be performed is displayed, the motor is set to the appropriate speed, and the repetition counter is set at the number of reps to be performed for the first set. Once the user views the video, he copies the movements and the rep counter decrements with each rep. Following the last rep, a new video automatically appears along with a new motor speed corresponding to the next exercise, and the rep counter is reset to the total number of reps to be performed for the next set. The user is automatically guided through an entire workout quickly without the need to make any adjustments to the machine. At the conclusion of the workout, a summary is provided detailing metrics such as average force applied, maximum force applied, total calories expended, etc.

In one embodiment, during a programmed workout, motor speed is adjusted on a rep-by-rep basis in order to create a more dynamic experience. For example, rep 1—default speed, rep 2—default speed, rep 3—default speed, rep 4—105% of default speed, rep 5—110% of default speed, etc.

The disclosure allows users to create their own custom programs. In one embodiment, a keyboard on the touch-screen panel is used for data entry. In another embodiment, a user can remotely create a workout on a separate computer, such as a home computer or cell phone, and export the workout to the user interface through direct connection such as a usb port, or wirelessly through Bluetooth, wifi, etc.

During the workout, movement data is recorded for each rep. For example, force data is recorded and stored every 10 ms during the repetition. This information can be displayed in real-time, or saved for future viewing.

The present disclosure includes a tracking feature which presents performance data in at least three formats: 1) Real-time chart-plotting—a graph is composed with force applied on the y axis, and elapsed time on the x axis. As a user pulls on a handle, the graph draws a range-of-motion force profile for each repetition; 2) Rep-by-rep graphing—a graph is composed for each set with either average force applied per rep, maximum force applied per rep, or work done per rep on the y axis, and repetition number on the x axis. With each successive repetition, a new point is plotted on the graph to show trend information throughout a set; and 3) Historical tracking—one graph is composed for each exercise performed, e.g. biceps. Either average force applied per set, maximum force applied per set, or total work done per set appears on the y axis, and workout session number appears on the x axis. After multiple workouts have been performed, a user can view this graph to chart performance gains.

As with the analog bar graphs, the present disclosure allows for automatic scaling on the graphs. For example, the x axis may display 10 points corresponding to 10 repetitions. As the user exercises and exceeds 10 repetitions, the x axis may automatically increase to 15 points to accommodate more data. The y axis may first be presented as zero to 25 pounds, however if the user pushes more than this amount, it may adjust to a new range of 20-50 pounds.

Alternatively, a table of values can be displayed in lieu of the charts. Rather than showing the information in an analog format, the table simply displays all numerical values recorded. This tracking information can be viewed on the touch-screen, sent to a server for later retrieval, shared with others, or transferred to the user's phone or computer via Bluetooth, wifi, internet, or with use of a memory stick.

Another feature of the disclosure is the ability to record and save performance data relating to a user and then replay that data (or "Ghost") on a display during a similar workout in the future for comparison. This helps the user to monitor progress, and creates an incentive to "beat" a previous workout. For example, if a user performs a programmed workout, e.g. "Basic Strength", force, work, and motor speed for each repetition of every set within the workout is recorded. The next time the user chooses "Basic Strength", he is given the option to compete with the "ghost". During a ghost competition, for each rep of each set, a metric is displayed showing the past performance for that rep. The user can now try to exceed the recorded value and beat the ghost. Ghosts can be saved and exported off of the computer to be shared with other similar machines for fun and competition.

An isokinetic resistance device can generate extremely high loads and there is always a risk of injury if not used properly. This becomes especially important in a rehabilitative environment. For example, a patient recovering from shoulder surgery may be advised to perform interior and exterior rotation exercises. Often these exercises are performed with fixed weights or elastic bands. The therapist will typically specify a resistance which represents only a fraction of the patient's maximum strength. Isokinetics without added feedback can be difficult to administer in this environment as there is risk of the patient overexerting.

The present disclosure uses visual feedback to display force production so a user can control his movement. Additionally, a user settable feature is disclosed which allows for a maximum resistance (e.g. 12 lbs) to be manually set. If the maximum resistance is exceeded by the user, the resistance is adjusted to protect from overload. This can be achieved in at least two ways: 1) Increase speed: when an overload is detected, the isokinetic speed control is commanded to change to a higher speed which makes it more difficult for the user to produce a high load; and 2) Constant force: when an overload is detected, the resistance is commanded to change from isokinetic to isotonic with a force equal to the maximum force set by the user. One method uses a dc motor to control isokinetic speed. The motor's ability to resist an increase in speed is limited by the amount of current available to the motor. When an overload is detected, the maximum current available to the motor is set at a value equal to the present amount of current being used by the motor. This will allow the motor to accelerate when greater amounts of force are attempted, thereby never exceeding the maximum force set. In any event, visual and audio alarms are also included to alert the therapist or patient that a maximum force has been applied.

Figure 10:
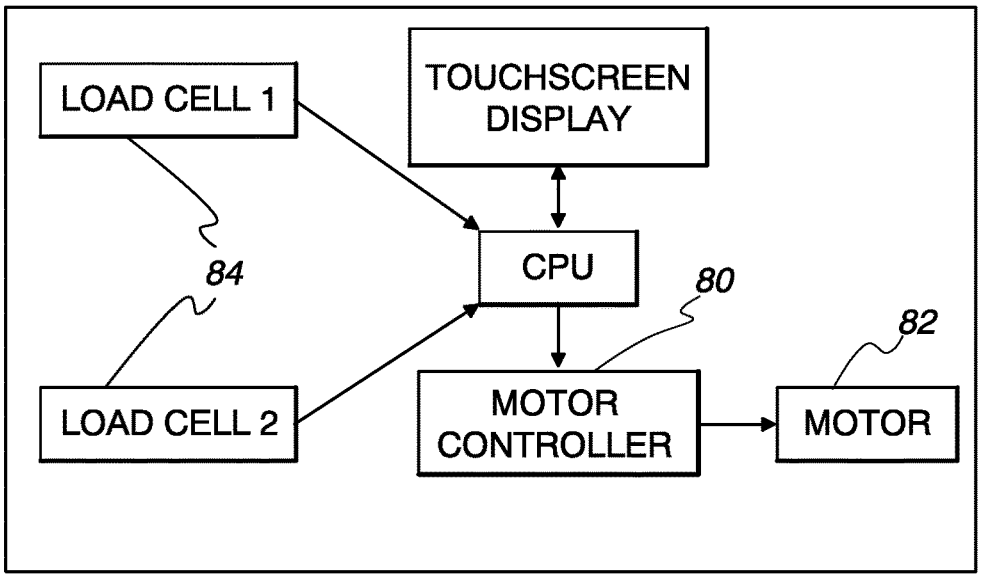
FIG. 10 is a logic flow according to the principles of an embodiment of the present disclosure.

In one embodiment of the present disclosure as shown in the logic flow of FIG. 10, a dc motor controller 80 drives a permanent magnet motor 82 at a fixed speed for isokinetic exercise by maintaining a constant voltage and varying the current based on the exercise load(s) 84. When used in this mode, the user is able to generate greater loads simply by pushing harder against the machine. In another mode, current is limited at a selectable amount. This causes the motor to only resist movement until a certain load is applied, at which point a constant force is delivered to the handle (isotonic exercise).

Another feature allows for visual and audio alarms to help a user work within a prescribed resistance level. For example, a trainer may direct his client to do 15 chest press exercises with a load of between 25-30 lbs. An alarm can be set to either alert the user when he achieves his goal, or when he doesn't achieve his goal. This feature can also be used within a programmed workout such that a program presents a series predetermined target force goals, for example: rep 1—55 lbs., rep 2—60 lbs, rep 3 65 lbs., rep 4—60 lbs, etc. With each new rep, a new force amount is displayed and feedback is given to alert the user as to whether he is achieving the goal.

The foregoing detailed description has been given for clearness of understanding only and no unnecessary limitations should be understood therefrom. Accordingly, while one or more particular embodiments of the disclosure have been shown and described, it will be apparent to those skilled in the art that changes and modifications may be made therein without departing from the invention if its broader aspects, and, therefore, the aim in the appended claims is to cover all such changes and modifications as fall within the true spirit and scope of the present disclosure.

What is claimed is:

1. An exercise apparatus comprising:

a plurality of isokinetic resistive mechanisms;

a first user engageable grip for a first hand of the user operatively coupled through a first flexible element to one of said plurality of isokinetic resistive mechanisms and a first force measuring device for measuring a force applied by a user movement in a first direction;

a second user engageable grip for a second hand of the user operatively coupled through a second flexible element to another one of said plurality of isokinetic resistive mechanisms and a second force measuring device for measuring a force applied by the user movement in a second direction; and a processor configured to determine and compare said first and second force measuring devices and displaying a resultant in force values associated with a respective one of the first user engageable grip and the second user engageable grip on a user interface.

2. The apparatus as defined in claim 1 wherein said processor determines a distance and associated work values and said interface displays said work values.

3. The apparatus as defined in claim 1 wherein said processor determines a speed and associated power values and said interface displays said power values.

4. An exercise apparatus comprising:

a motorized isokinetic resistive mechanism moving at a set speed to provide an isokinetic resistive force;

a user engageable grip coupled through a flexible element to said resistive mechanism;

a force measuring device for determining when a force is applied to the grip by the user that is above a threshold of the isokinetic resistive force; and a control for increasing said speed of said resistive mechanism when said force applied by the user exceeds said threshold.

5. An exercise apparatus comprising:

a motorized isokinetic resistive mechanism moving at a set speed to provide an isokinetic resistive force;

a user engageable grip coupled through a flexible element to said resistive mechanism;

a force measuring device for measuring a force applied to the grip by the user;

a user interface for user selection of a threshold isokinetic resistive force value; and a control for limiting a current to said resistive mechanism when said force applied by the user exceeds said threshold.

* * * * *